United States Patent [19]

Riihiluoma et al.

[11] Patent Number: 4,927,157

[45] Date of Patent: May 22, 1990

[54] CHESS-LIKE BOARD GAME APPARATUS AND METHOD OF PLAYING THE SAME

[76] Inventors: Clayton Riihiluoma, 3923 Foss Rd., No. 101, Minneapolis, Minn. 55421; Kurt R. Miller, 4902 London Rd., Duluth, Minn. 55804

[21] Appl. No.: 410,002

[22] Filed: Sep. 19, 1989

Related U.S. Application Data

[63] Continuation of Ser. No. 697,270, Feb. 1, 1985, abandoned, which is a continuation of Ser. No. 409,260, Aug. 19, 1982, Pat. No. 4,494,868.

[51] Int. Cl.[5] ..... A63F 3/02

[52] U.S. Cl. ..... 273/260; 273/241; 273/243

[58] Field of Search ..... 273/260, 261, 242, 243, 273/241

[56] References Cited

U.S. PATENT DOCUMENTS

| | | | |
|---|---|---|---|
| D. 200,109 | 1/1965 | Hirsch | 273/241 X |
| D. 226,669 | 4/1973 | Culver | 273/241 X |
| 1,405,988 | 2/1922 | Erwin | 273/260 |
| 1,674,533 | 6/1928 | Templeton | 273/284 |
| 3,121,566 | 2/1964 | Manea . | |
| 3,169,769 | 2/1965 | Cornish . | |
| 3,399,895 | 9/1968 | Beach | 273/241 |
| 3,608,904 | 9/1971 | Margetson . | |
| 3,656,756 | 4/1972 | Gribbon, Jr. | 273/241 |
| 3,684,285 | 8/1972 | Kane | 273/241 |
| 3,767,201 | 10/1973 | Harper et al. | 273/241 |
| 3,794,326 | 2/1974 | Bialek | 273/260 |
| 3,806,125 | 4/1974 | Bialek | 273/260 |
| 3,844,563 | 10/1974 | Isaac | 273/284 X |
| 3,856,309 | 12/1974 | Helfgott . | |
| 3,871,657 | 3/1975 | Lorenz et al. . | |
| 4,126,315 | 11/1978 | Tung | 273/271 |
| 4,133,537 | 1/1979 | Chappell | 273/241 |
| 4,194,741 | 3/1980 | Rea | 273/243 |
| 4,211,420 | 7/1980 | Quiroz | 273/260 |
| 4,226,419 | 10/1980 | Wooden | 273/260 |
| 4,252,320 | 2/1981 | Rouse . | |

FOREIGN PATENT DOCUMENTS

| | | | |
|---|---|---|---|
| 433081 | 9/1967 | Switzerland | 273/260 |

*Primary Examiner*—Edward M. Coven
*Assistant Examiner*—William E. Stoll
*Attorney, Agent, or Firm*—Merchant, Gould, Smith, Edell, Welter & Schmidt

[57] ABSTRACT

A chess-like board game apparatus (110) is disclosed. The apparatus (110) includes a first game board (112) having forty-two playing positions arranged in six file rows and seven rank rows. Two of the positions include obstructions thereon such that they are not available for occupancy by a playing piece. The game is played by two opponents, each using four playing pieces corresponding to the king, knight, rook and bishop of the conventional game of chess. A die is utilized to introduce the element of chance.

6 Claims, 2 Drawing Sheets

FIG. 1
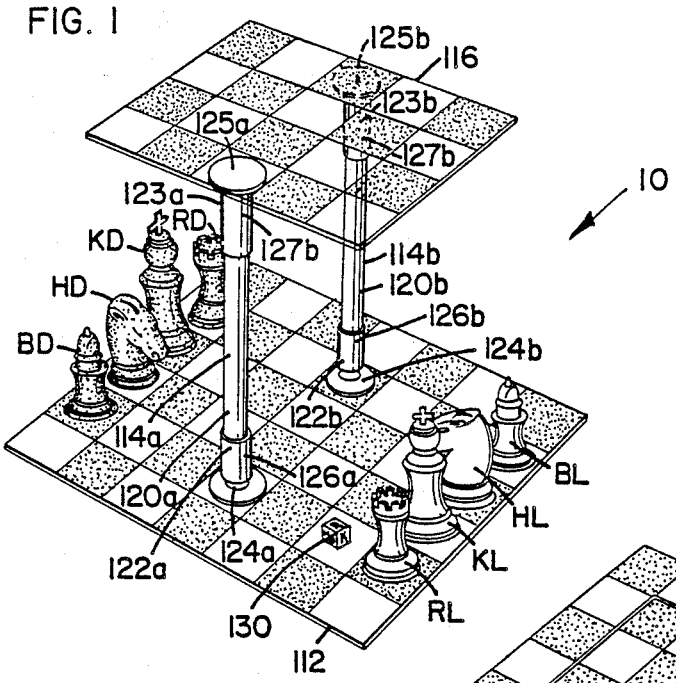
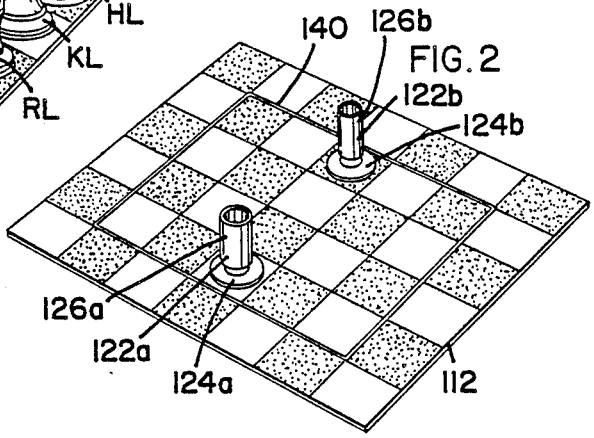
FIG. 2
FIG.5A
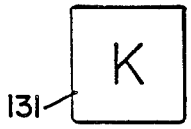
FIG.5B
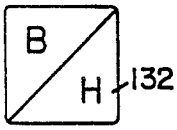
FIG.5C
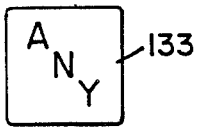
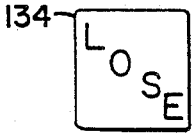
FIG.5D
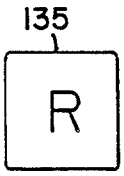
FIG.5E
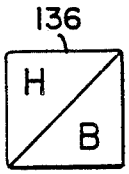
FIG.5F

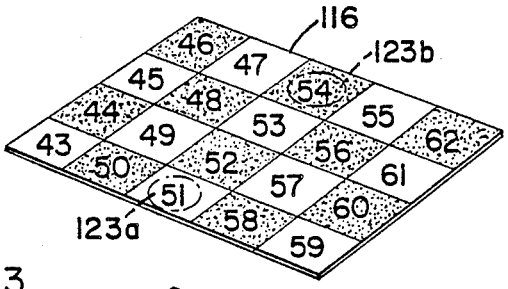
FIG. 3
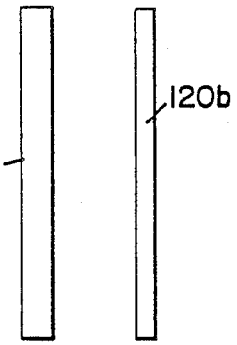
FIG. 7A
FIG. 7B
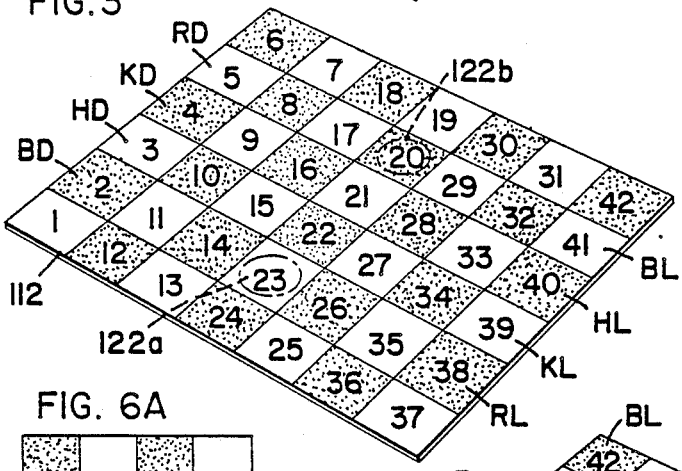
FIG. 6A
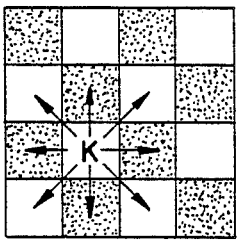
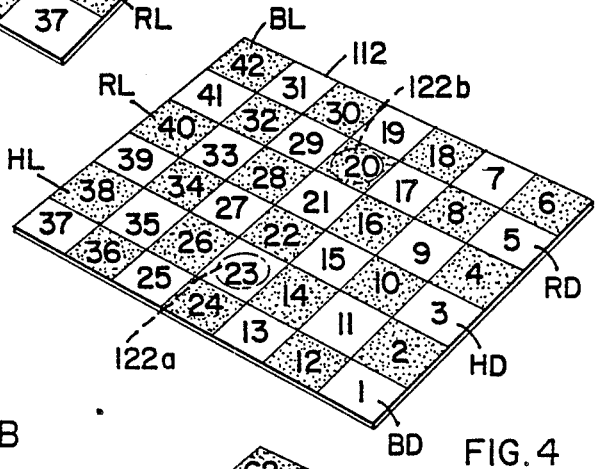
FIG. 4
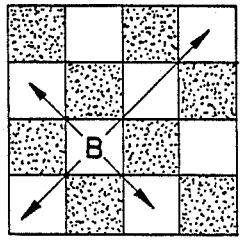
FIG. 6B
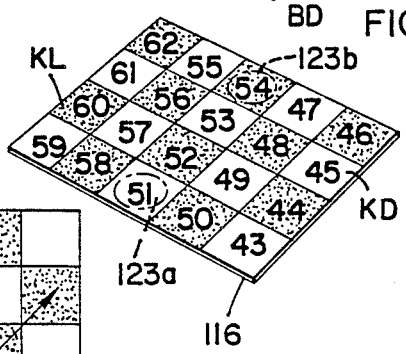
FIG. 6C
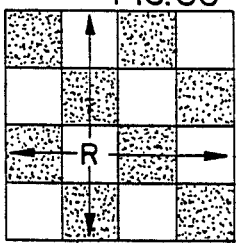
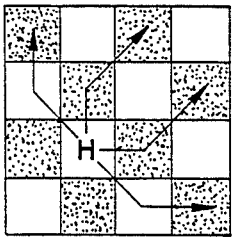
FIG. 6D

CHESS-LIKE BOARD GAME APPARATUS AND METHOD OF PLAYING THE SAME

This is a continuation of application Ser. No. 697,270, now abandoned, filed Feb. 1, 1985 which is a continuation of 409,260 filed Aug. 19, 1982, now U.S. Pat. No. 4,494,868.

TECHNICAL FIELD OF THE INVENTION

The present invention relates to a board game apparatus and more particularly to a chess-like board game apparatus.

BACKGROUND OF THE INVENTION

The game of chess is well known. Typically the game is played on a relatively flat rectangular game board, the configuration of which has not changed significantly over the years, and according to rules which likewise are basically the same as they were in the distant past. The rules of conventional chess are such that the game is relatively complex and often requires a substantial period of time to complete a game.

Over the past few years, in an effort to make the game of chess even more complex and challenging, three dimensional chess game boards and rules have been introduced. Examples of such games are U.S. Pat. Nos. 3,656,756 issued to Gribbon, Jr., 3,684,285 issued to Kane, and 3,767,201 issued to Harper et al. These multi-level chess games utilize either a conventional set of chess playing pieces or additional playing pieces. Consequently, due to the increased number of playing surfaces and playing pieces, these multi-level chess games are even more complex than conventional chess and often require even more prolong periods of play.

While some players may find this challenging, many find the conventional game of chess and the three dimensional chess games to be rather monotonous and uninteresting due to the prolonged periods of play required and the intense concentration required during the course of play.

Additionally, the three dimensional chess games require even more skill and playing experience for a reasonable degree of proficiency at playing the game to be obtained thereby making it less likely for a beginner player to enjoy the game. Additionally, it is very difficult for a beginning player to learn the conventional game of chess or the three dimensional chess games due to the complexity of the game. Indeed, the complexity of these games often intimidates people from even attempting to learn the game of chess.

Furthermore, the contrast between the relative skills of two players is even more accentuated which often results in rather one sided and uninteresting games.

A modified chess game is disclosed in U.S. Pat. No. 3,794,326 issued to Vialek which utilizes a die to introduce the element of chance. However, the game utilizes a conventional chess board having sixty-four squares and the conventional number of chess players, thirty-two. Consequently, the game is still relatively complex and time consuming.

The present invention solves these and many other problems associated with the prior art.

SUMMARY OF THE INVENTION

The present invention relates to a game board apparatus for a chess-like game having a plurality of playing pieces. The game board apparatus comprises a first relatively flat game board defining a plurality of positions on the surface thereof, the positions being arranged in perpendicular rank and file rows with alternate ones of the positions being distinguishable from the others so as to form a checkboard pattern. At least one of the positions includes an obstruction thereon for obstructing the movement of the playing pieces and for preventing the occupancy of the obstructed position by a playing piece, the remaining positions providing playing positions.

The present invention further relates to a board game apparatus including a first game board defining a generally horizontal playing surface, the playing surface defining a plurality of playing positions arranged in generally perpendicular rank and file rows. The board game apparatus further includes two sets of playing pieces, each of the sets of the playing pieces being distinguishable from the other set, with each of the playing pieces within a set being further identifiable from the remaining playing pieces within the set. At least one of the playing positions includes an obstruction thereon for preventing the playing pieces from occupying that position, the remaining positions providing playing positions capable of being occupied by the playing pieces.

The present invention further relates to a method of playing a board game including two sets of distinguishable playing pieces and a game board defining playing positions arranged in perpendicular rank and file rows, the game board further including obstructed positions which can not be occupied by a playing piece and further prevent the movement of the playing pieces across the obstructed position. The method comprises steps of positioning each set of playing pieces at predetermined positions of the two rank rows along the edge of the game board, the players rolling a die in a alternating fashion to determine which of the playing pieces may be moved during a player's turn, and moving one of the playing pieces, designated by the die as being available for movement, along the surface of the game board in accordance with predetermined game rules.

In yet another embodiment of the present invention, the board game apparatus is played according to conventional chess rules except that a die is utilized to determine which player or players, if any may be moved during a player's turn. In addition, only four playing pieces per player are utilized, these playing pieces corresponding to the king, knight, bishop and rook of the conventional game of chess. Furthermore, an obstruction is positioned on at least one of the playing positions such that a playing piece may not occupy that position or move across that position during any given move. Finally, the playing surface has fewer positions than in the conventional game of chess, with forty playing positions and two obstructed positions being utilized in one embodiment of the present invention.

In yet another embodiment of the present invention, a second game board is positioned above the surface of the first game board such that the playing positions in the rank and file rows are vertically aligned. In a preferred embodiment, the upper game board has fewer playing positions than the lower game board. The rules of conventional chess are modified to enable a playing piece to be moved vertically from one game board to the other or to be moved on the horizontal surface of the game board, wherein it is located, according to the conventional rules of chess.

In yet another embodiment of the present invention, the die is not utilized, the players taking turns at moving their respective playing pieces.

It will be appreciated that while the variations to the present invention are many, the present invention provides an educational tool for the beginner learning the conventional game of chess. An advantage of the present invention is due to the fact that the reduced number of playing pieces and playing positions, result in an overall reduction in the complexity of the game. In addition, the present invention is very entertaining in that it is fast moving and involves varying degrees of strategy. Thus the present invention not only provides a tool for introducing the non-skilled or beginner players to the basic concepts of conventional chess but also provides a novel game which is both stimulating and interesting.

A further advantage of the present invention is that because of the reduced complexity, the difference in relative skill levels between the players is not as noticeable thereby providing for more even contests between players.

Additionally, the use of the die in the present invention further negates the differences in skill and playing experience between players as the element of chance is introduced and the options available to a player during a turn are limited. This reduces the complexity of the decision making process.

A further advantage of the present invention is that unlike other chess type games, obstructions on the playing surface are utilized as a functional part of the overall game strategy. Additionally, the obstructions in one embodiment of the present invention are placed in key positions on the playing surface to prevent one player from capturing an opponent's playing piece on the first or initial moves of the game.

Furthermore, the present invention provides a variety of game options with varying degrees of complexity and chance involved. Consequently, the present invention can be enjoyed by a beginner players and experienced players alike.

These and various other advantages and features of novelty which characterize the present invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views, FIG. 1 is a perspective view of the present invention including a two level game board apparatus;

FIG. 2 is a perspective view of a single level game board of the present invention including obstructions thereon;

FIG. 3 is a perspective view of the playing area provided by the two level game board apparatus of the present invention, showing the positions of the playing pieces at the commencement of a game;

FIG. 4 is a perspective view of the playing area provided by the two level game board apparatus illustrated in FIG. 3 in an inverted position, showing the positions of the playing pieces at the commencement of a game;

FIGS. 5A through 5G are plan and elevational views of one embodiment of the die of the present invention;

FIG. 6A through 6D are plan views of the bottom of the playing pieces in one embodiment of the present invention; and FIGS. 7A through 7B are elevational views of the support members of one embodiment of the present invention.

DETAILED DESCRIPTION OF THE PRESENT INVENTION

Referring now to the drawings there is illustrated in FIG. 1 a chess-like board game apparatus in accordance with the principals of the present invention, generally designated by the reference numeral 10. In the embodiment shown, the game apparatus 10 includes a relatively flat, rectangular game board 112 having a total of forty-two positions or squares, designated 1 through 42 as illustrated in FIG. 3, of alternating color, juxtaposed to one another so as to form a checkboard pattern. Supported above the game board 112 by elongated support members 114*a, b* is a second game board 116 having twenty squares, designated as 43 through 62 as illustrated in FIG. 3, of alternating color juxtaposed to one another so as to form a checkboard pattern. In a preferred embodiment, the squares have an alternating black and transparent color scheme.

The playing positions 1 through 42 of the game board 112 are arranged in six file rows and seven rank rows while the playing positions 43 through 62 of the game board 116 are arranged in four file rows and five rank rows. The game boards 112 and 116 are disposed about a common vertical axis which extends through the center of the playing boards such that the rank rows and file rows are vertically aligned. Furthermore, the squares 43 through 62 of the second game board 116 are vertically aligned with the squares 1 through 42 of the first game board 112 such that the black squares of the game board 116 are vertically aligned with the black squares of the game board 112, the same being true of the transparent squares.

As illustrated in FIG. 1, the support members 114*a, b* include elongated cylinders 120*a, b* respectively and two pedestal portions 122*a, b* 123*a, b* respectively at opposing ends thereof which are fixedly secured to the game boards in a suitable fashion. It will be appreciated that support members having alternate configurations, e.g. rectangular elongated members, etc., may be utilized in keeping with the principles of the present invention. As illustrated in FIG. 3, the lower pedestals 122*a, b* are fixedly attached to the top playing surface of the game board 112 at positions 23 and 20 so as to occupy two of the forty-two playing positions on the playing surface of the game board 112, while the upper pedestals 123*a, b* are fixedly attached to the bottom of the game board 116 directly below playing positions 51 and 54.

In a preferred embodiment, as illustrated in FIGS. 1 and 2, the pedestal portions 122*a, b* and 123*a, b* include base portions 124*a, b* and 125*a, b* respectively which are suitably affixed to the game board and further include hollow vertically oriented cylinder portions 126*a, b* and 127*a, b* respectively, which are attached to the base portion and adapted for releasable receipt of the elongated cylinders 120*a, b*. Consequently, it is possible to remove the elongated cylinders 120*a, b* from their pedestals 122*a, b* and 123*a, b* so as to utilize the game board 112 separately as illustrated in FIG. 2 thereby providing a single level, two dimensional playing surface with only forty available positions capable of being occupied by the playing pieces. Furthermore, if so desired, the two game board configurations may be utilized with the game board 112 supported above the surface of the game board 116. It will be appreciated, that in this configuration, the pedestals 123*a, b* will occupy the positions 51 and 54 on the playing surface of the board 116 so as to serve as obstructions, while the pedestals 122*a, b* will be attached to the bottom of the board 112 at the locations 23 and 20 so as to not serve as obstructions.

In addition, in a preferred embodiment of the present invention as illustrated in FIGS. 7A through 7B, the elongated cylindrical members 120*a, b* have varying diameters as correspondingly do the cylinder portions of the pedestals 122*a, b* and 123*a, b*. The larger support member 120*a* is constructed and arranged such that it will not fit into the smaller pedestals 122*b* and 123*b* thereby assuring that positions of the same color will be vertically aligned, i.e. clear positions will be vertically aligned with clear positions and dark positions will be vertically aligned with dark positions when the two board configuration is assembled. It will be appreciated, that other variations of the support members 114*a, b* might be utilized to achieve the same function. In yet other embodiments of the present invention, the elongated cylindrical members 120*a, b* will have the same general configurations so as to enable interchangeability.

The playing pieces utilized in a preferred embodiment of the present invention include two identical sets of playing pieces, the sets being differentiated from one another by color as generally illustrated in FIG. 1. Each set has four playing pieces with each of the playing pieces in a set being distinguishable from the other members of the set. In the preferred embodiment, the playing pieces correspond to the king, knight, bishop and rook playing pieces in the conventional game of chess and will hereinafter be referred to as such.

In FIG. 1, the playing pieces are shown in their starting position, at the commencement of a game. In FIG. 3, the playing positions are individually numbered, with the starting positions of the playing pieces being indicated by their letter designations as defined in the table below:

| Playing Pieces | Dark | Light |
|---|---|---|
| King | $K_D$ | $K_L$ |
| Bishop | $B_D$ | $B_L$ |
| Knight | $H_D$ | $H_L$ |
| Rook | $R_D$ | $R_L$ |

In addition, below in tabular format are the starting positions for each of the playing pieces when either only the game board 112 is being utilized or both of the game boards 112 and 116 are being utilized with the game board 116 being supported above the game board 112.

| Dark Playing Pieces | Square | Light Playing Piece | Square |
|---|---|---|---|
| $K_D$ | 4 | $K_L$ | 39 |
| $B_D$ | 2 | $B_L$ | 41 |
| $H_D$ | 3 | $H_L$ | 40 |
| $R_D$ | 5 | $R_L$ | 38 |

As previously mentioned the game boards 112 and 116 may be inverted such that the game board 112 is supported above the game board 116. As illustrated in FIG. 4, when this configuration is utilized the kings are placed anywhere on the game board 116 at the commencement of the game and the remaining playing pieces are placed anywhere on the board 112 so long as a playing piece does not immediately threaten an opposing playing piece. The kings must remain on the game board 116 throughout the course of the game. An example of possible positioning of the playing pieces is illustrated in FIG. 4.

The game of the present invention is intended to be played by two people, the object of the game being the same as that of conventional chess, namely to capture the opposing king by moving a playing piece to the square occupied by the opposing king. The playing pieces have the same basic moves as the king, knight, bishop and rook playing pieces in the game of conventional chess. The standard rules of conventional chess are utilized throughout the course of the game except as hereinafter described.

As illustrated in FIG. 1, the preferred embodiment of the present invention includes a die 130 comprising a cube having six symmetrical square sides 131 throught 136 as illustrated in FIGS. 5A through 5G. The die 130 is utilized to introduce the element of chance into the game with play being determined by the roll of the die. When the die is utilized, each player rolls the die upon his/her turn. As illustrated in FIGS. 5A through 5G, each of the die sides 131 through 136 includes indicia thereon designating the playing piece, if any, which may be moved during the player's turn. Below is a table designating the moves represented by each of the six sides of the die 130:

| Die Indicia | Players which may be moved |
|---|---|
| K | KING |
| B/H | BISHOP or KNIGHT |
| ANY | ANY PLAYING PIECE |
| LOSE | LOSE TURN |
| R | ROOK |
| H/B | KNIGHT or BISHOP |

In the preferred embodiment, there are two sides carrying H/B and B/H designations. If a player does not have the playing piece designated by the die on the game board, he/she looses his/her turn. It will be appreicated that variations in the die 130 indicia may be made in keeping with the principles of the present invention.

In yet another embodiment, the die 130 is not utilized so that a player may move any of the playing pieces left on the game board when it is his/her turn, thereby removing the element of chance from the game.

As previously mentioned, the present invention may be played with one or a plurality of game boards. If both of the game boards 112 and 116 are utilized then the following game rules are followed:

(1) Any playing piece on the lower board and directly under a square of the upper board may be moved vertically to the square directly above instead of moving the playing piece according to its conventional moves on the lower board;

(2) If an opposing playing piece occupies the square directly above, when a vertical move is made, the opposing playing piece is removed from the game. A playing piece cannot be moved vertically to a square directly above which is occupied by a playing piece of the same set; and (3) Once a playing piece is on the upper board, it may be moved according to conventional rules or may be returned to the lower board by moving to the playing square directly below it, however, once again if an opposing playing piece occupies that square then the opposing playing piece is removed from the game. In addition, a playing piece can not be moved vertically to the square directly below which is occupied by a playing piece of the same set.

A very significant feature of the present invention is the use of the two pedestals 122*a, b* located on the playing positions 23 and 20 as obstructions preventing a playing piece from occupying the positions 23 and 20 or moving across the positions 23 and 20 during the course of a move. For example; if at the beginning of the game a player were to move the dark rook ($R_D$), he/she could not capture the opposing light bishop ($B_L$) as the obstruction 122*b* would prevent the rook ($R_D$) from moving from one end of the game board 112 to the other. In the preferred embodiment, the obstructions are strategically placed in the fourth rank row and the second file row from each edge of the game board 112 to prevent the player at the commencement of a game from immediately capturing an opposing playing piece with one move. In addition, the obstructions must be further considered in any game strategy.

Furthermore, if the game boards 112 and 116 are positioned such that the game board 112 is supported above the game board 116, then the pedestals 123*a, b* serve as obstructions on the game board 116 at positions 51 and 54.

In one embodiment of the present invention as illustrated in FIG. 2, the game board 112 has marked thereon by suitable indicia 140, the outline or boundary of the game board 116. This assists in definding the squares of the game boards 112 and 116 wherein a vertical move may be made using the two board configuration.

In yet another embodiment of the present invention as illustrated in FIGS. 6A through 6D, the moves of each particular playing piece are marked on the bottom of each playing piece. This is especially helpful for those first learning to play the game. Should a player forget the moves available for a particular playing piece, he/she need only to look at the bottom of that particular playing piece without having to read any written rules. It will be appreciated that various indicia can be utilized to indicate the various moves available for a particular playing piece.

Yet another embodiment of the present invention includes suitable indicia of the game boards 112 and 116 indicating the starting positions of the playing pieces at the commencement of a game.

It will be understood that the game of the present invention can be played with additional playing pieces. For example, five or six playing pieces per set might be utilized, the additional playing pieces corresponding to pawns in the conventional game of chess and being moved accordingly. When five playing pieces are utilized, a pawn (P) might be placed directly in front of the king (K). If the two board game configuration were being utilized with six playing pieces, the second pawn (P) might be placed on the game board 116 vertically above the space in front of the knight (H).

If a die were utilized with the five or six player sets, one of the sides having the H/B or B/H indicia might be replaced with the indicia P indicating that a pawn (P) was to be moved.

While the variations to the present invention are many, it will be appreciated that the present invention provides an educational tool for learning the conventional game of chess. Because of the reduced number of playing positions and the reduced number of playing pieces, the overall complexity and difficulty of the game is reduced, thereby providing a tool for introducing the non-skilled or beginning players to the basic concepts of conventional chess in a way in which is both stimulating and interesting. Furthermore, the present invention is very entertaining in that it is fast moving and does involve some degree of strategy. Because of the reduced complexity, difference in skill levels are not as noticeable thereby providing for more even contests.

Furthermore the difference in skill and playing experience are further negated by using a die which introduces the element of chance and limits the options available to a player during his/her turn, thereby reducing the complexity of the decision making process. Consequently, the present invention can be enjoyed by beginner players and experienced players alike.

In addition, the present invention provides a variety of game options of varying complexity. Furthermore, the present invention unlike other chess type games utilizes obstructions as a functional part of the game strategy. Additional, the obstructions prevent the player of capturing an opponent's playing piece on the first or initial moves of the game.

It should be understood, that even though the above numerous characteristics and advantages of the present invention have been setforth in the foregoing description, together with details of the structure and function of the invention, the disclosure is illustrative only, and changes may be made in detail, especially in matters of shape, size and arrangement of parts within the principal of the invention, to the full extent indicated by the broad general meaning of the terms in which the appended claims are expressed.

What is claimed is:

1. A board game apparatus for a chess-like game having multiple playing pieces, comprising:

(a) a first generally flat game board defining a playing surface with forty-two identifiable positions arranged in seven rank and six file rows, forty of the identifiable positions being playing positions available for occupancy and movement thereacross by the playing pieces, two of the identifiable positions being non-playing positions, which are not available for occupancy or for movement thereacross by the playing pieces, one of said non-playing positions being positioned in a second file row from a first side edge of the game board and one of said non-playing positions being positioned in a second file row from a second side edge of the game board, both of said non-playing positions being positioned in a fourth rank row from both ends of the game board;

(b) two sets of distinguishable playing pieces, each of said sets having less than sixteen playing pieces and including four playing pieces being identifiable from one another, the moves of said four identifiable playing pieces being defined according to a predetermined set of game rules, said four identifiable playing pieces having moves similar to those of the king, knight, bishop, and rook in the game of chess; and (c) each of the two sets of playing pieces being positioned in the opposing rank rows immediately adjacent opposite ends of the game board at the start of the game, the bishop and rook playing pieces being positioned in the second file rows from the side edges of the game board so as to be in the same file rows as the non-playing positions at the start of the game, the knight and rook playing pieces of each set of playing pieces being positioned in the third file rows from the side edges of the game board.

2. A board game apparatus in accordance with claim 1, further including a die having indicia thereon designating various ones of the playing pieces.

3. A game board apparatus in accordance with claim 1, wherein there are less than eight of said playing pieces in each of said sets of playing pieces, there being only one each of said four identifiable playing pieces having moves corresponding to the king, knight, bishop and rook of the game of chess.

4. A game board apparatus in accordance with claim 3, further including a die having indicia thereon designating various ones of said playing pieces.

5. A board game apparatus, comprising:

(a) two identifiable sets of playing pieces, each of said sets having less than sixteen playing pieces, each of said sets having four playing pieces distinguishable from one another and having moves corresponding to the king, knight, bishop and rook, in the conventional game of chess;

(b) a generally flat game board having a playing surface with first and second side edges and first and second end edges, the playing surface being divided into forty-two identifiable positions arranged in seven rank and six file rows, the file rows extending parallel to the first and second side edges and the rank rows extending parallel to the first and second end edges, forty of the positions being identified as playing positions and two of the positions being identified as non-playing positions, only the playing positions being available for occupancy and movement thereacross by the playing pieces, one of said non-playing positions being positioned in a second file row from a first side edge of the game board and one of said non-playing positions being positioned in a second file row from a second side edge of the game board, both of said non-playing positions being positioned in a fourth rank row from both ends of the game-board; and (c) the four identifiable playing pieces corresponding to the king, knight, bishop and rook of each set of playing pieces being positioned in the opposing rank rows immediately adjacent opposite ends of the game board at the start of the game, the bishop and rook playing pieces being positioned in second file rows from the side edges of the game board so as to be in the same file rows as the non-playing positions at the start of the game, the knight and rook playing pieces of each set of playing pieces being positioned in the third file rows from the side edges of the game board at the start of the game.

6. A game board apparatus in accordance with claim 5, wherein there are less than six of said playing pieces in each of said sets of playing pieces, there being only one each of said pieces having moves corresponding to the king, knight, bishop and rook of the game of chess.

* * * * *

UNITED STATES PATENT AND TRADEMARK OFFICE
CERTIFICATE OF CORRECTION

PATENT NO. : 4,927,157

DATED : May 22, 1990

INVENTOR(S) : Riihiluoma et al.

It is certified that error appears in the above-identified patent and that said Letters Patent is hereby corrected as shown below:

On the title page, in the title, delete "AND METHOD OF PLAYING THE SAME".

On the title page, under heading "Related U.S. Application Data," delete "409,260" and insert therefor --409,360--.

In column 1, in the title, delete "AND METHOD OF PLAYING THE SAME".

In column 1, line 7, delete "409,260" and insert therefor --409,360--.

In column 3, line 41, delete "a" after the word "by".

In column 5, line 65, delete "Pieces" and insert therefor --Piece--.

In column 6, line 29, delete "throught" and insert therefor --through--.

UNITED STATES PATENT AND TRADEMARK OFFICE

CERTIFICATE OF CORRECTION

PATENT NO. : 4,927,157

DATED : May 22, 1990

INVENTOR(S) : Rithiluoma et al.

It is certified that error appears in the above-identified patent and that said Letters Patent is hereby corrected as shown below:

In column 6, lines 54 and 55, delete "appreicated" and insert therefor --appreciated--.

In column 7, line 44, delete "definding" and insert therefor --defining--.

Signed and Sealed this

Fifteenth Day of December, 1992

*Attest:*

DOUGLAS B. COMER

*Attesting Officer*

*Acting Commissioner of Patents and Trademarks*